US006789791B2

(12) United States Patent
Genduso

(10) Patent No.: US 6,789,791 B2
(45) Date of Patent: Sep. 14, 2004

(54) INTERIOR C-CLAMP'S HOLDING-DEVICE

(76) Inventor: Albert Genduso, Palms W. Post Office, West Palm Beach, FL (US) 33411

( * ) Notice: Subject to any disclaimer, the term of this patent is extended or adjusted under 35 U.S.C. 154(b) by 29 days.

(21) Appl. No.: 10/219,879

(22) Filed: Aug. 16, 2002

(65) Prior Publication Data

US 2004/0032070 A1 Feb. 19, 2004

(51) Int. Cl.[7] ..... B25B 5/00

(52) U.S. Cl. ..... 269/249; 269/143; 269/3; 269/6

(58) Field of Search ..... 269/249, 149, 269/148, 248, 143, 6, 3; 29/276, 278, 256

(56) References Cited

U.S. PATENT DOCUMENTS

| | | | | | |
|---|---|---|---|---|---|
| 1,412,961 | A | * | 4/1922 | Periolat | 81/3.7 |
| 1,498,638 | A | * | 6/1924 | Periolat | 269/47 |
| 3,055,654 | A | | 9/1962 | Harrison | 269/241 |
| 3,066,931 | A | | 12/1962 | Beals | 269/173 |
| 3,147,003 | A | | 9/1964 | Johnson | 269/167 |
| 3,997,152 | A | * | 12/1976 | Sass et al. | 269/249 |
| 4,583,307 | A | | 4/1986 | Wang | 269/182 |
| 4,823,636 | A | | 4/1989 | Suska | 24/569 |
| 4,837,915 | A | * | 6/1989 | Willms | 29/426.4 |
| 5,568,916 | A | | 10/1996 | Gibbons | 269/174 |
| 5,893,553 | A | | 4/1999 | Pinkous | 269/249 |
| 6,029,964 | A | | 2/2000 | Bohl | 269/6 |
| 6,098,973 | A | | 8/2000 | Khachatoorian | 169/181 |
| 6,113,089 | A | | 9/2000 | Kleinbongartz | 269/166 |
| 6,250,621 | B1 | | 6/2001 | Ping | 269/181 |
| 6,257,565 | B1 | * | 7/2001 | Houston et al. | 269/249 |

* cited by examiner

*Primary Examiner*—Lee D. Wilson

(57) ABSTRACT

An interior c-clamp's holding-device (10), for repairing cracks in violins without removing the soundboard (18) (top of the violin), comprising a housing (15) located at the bottom-end of a c-clamp (21). The housing (15) has both a horizontal and a vertical passage bored through the housing (15) creating an intersection inside the housing (15) where the two bores meet.

8 Claims, 8 Drawing Sheets

INTERIOR C-CLAMP'S HOLDING-DEVICE

BACKGROUND

1. Field of the Invention

Figure 1:
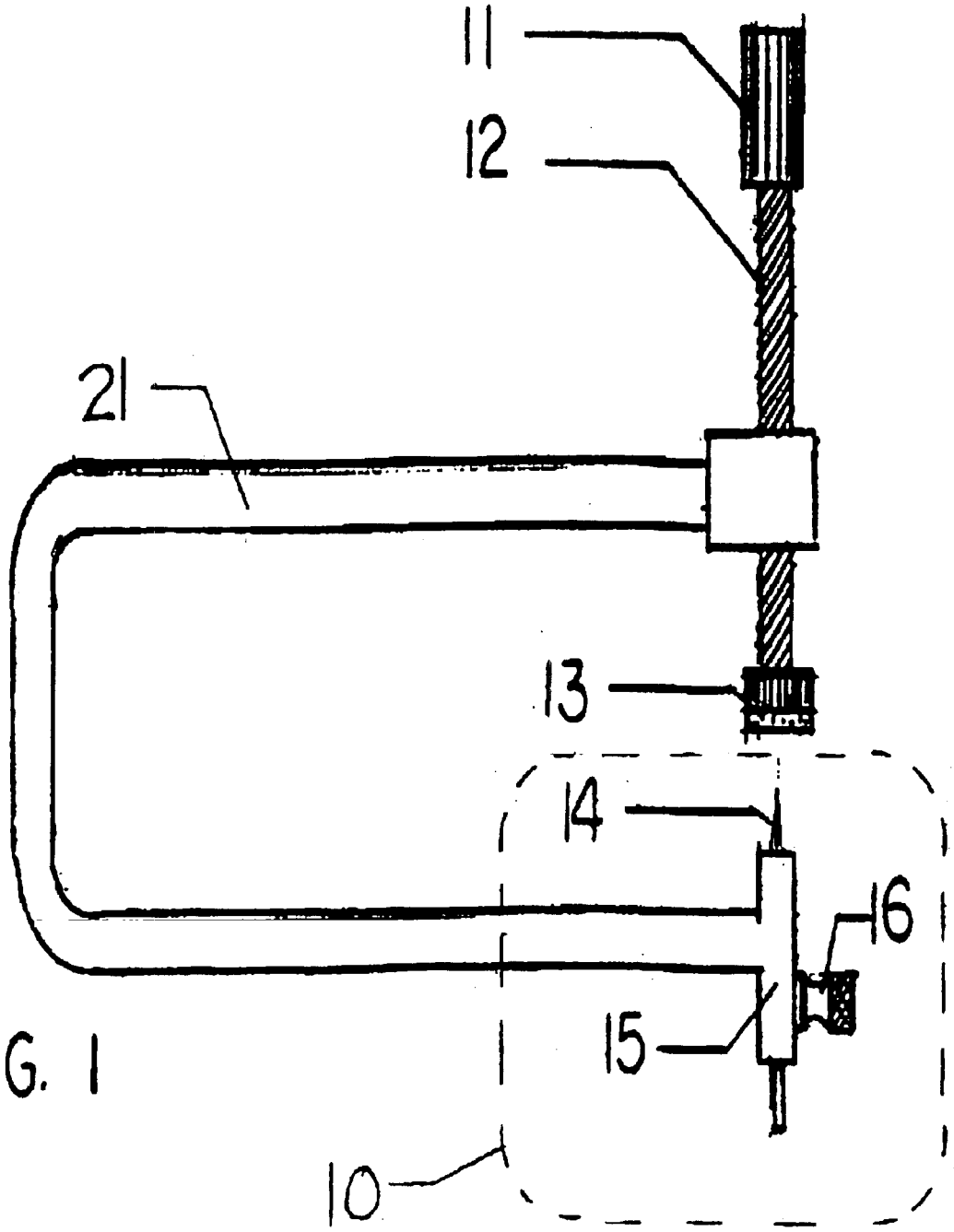

This invention relates to a c-clamp's holding-device, specifically a holding-device that can repair cracks on the interior of violin without opening the violin.

2. Description of Prior Arts

Cracks in violin are repaired on the interior of the violin with repair-cleats, small delicate reinforcing blocks of wood, glued across the cracks from the interior of the violin to keep the cracks from reopening or spreading any further.

All of which has required removal of the violin's soundboard to access the interior of the violin, to apply said repair cleat across the cracks on the interior of the violin. Removing the violin's soundboard is commonly described as "removing the top of the violin" or "opening the violin".

However, removing the violin's soundboard exposes the violin to additional accidents or damage including:

a) Violins's ribs cracking or splitting b) The edges of the soundboard splitting or splintering.

c) Additional cracking in the soundboard.

d) Movement of the neck of the violin causing a change to the alignment with the rest of the violin.

e) The need for new sound-post and sound-post alignment f) The list of problems and potential problems is extensive.

Resulting with the above repair-method creating additional time and labor cost to consumers, and additional trauma to the violin.

However, 'logic' reveals a simple-repair-method for preventing the above additional repairs in violins—to repair cracks—is to be able to apply the repair-cleats across the cracks on the interior of the violin without removing the violin's soundboard.

NOTE: Through the violins' soundboards are original f-shaped sound-holes designed to allow air to move—in and out—of the violin, producing musical sounds from the violin's strings to project from the violin.

Said simple-repair-method can be utilized through violin's f-shaped sound-holes, which would require a c-clamp equipped with a holding-device.

Inventors have created many types of clamps and C-clamps including:

U.S. Pat. No. 1,412,961 to Periolat (1922) 'Clamp'. . . to be serviceable in spreading apart the leaves of elliptic vehicle springs in the process of lubricating the latter.

U.S. Pat. No. 1,498,638 to Periolat (1924) Press: An Improvement in Presses. Invention relates to combination tools. It is similar to a C-clamp . . . which in one position provides a work support and in a reversed position forms a leaf spring spreader.

U.S. Pat. No. 3,997,152 to Sass (1976) 'Clamping Arrangement' A clamp for holding a work piece in position. Clamp is suitably reinforced by reinforcement ridges.

U.S. Pat. No. 4,837,915 to Willms (1989) Method of Breading Bearings: A system and method for use in quickly and easily removing bearings and collars from shafts, without damaging the shafts.

U.S. Pat. No. 6,257,565 to Houston (2001) Decking Clamp and Method of Making the Same: A decking clamp for use in an under-hung roof system.

U.S. Pat. No. 3,005,654 to Harrison (1962) Screw Clamp: for rapid and maximum mechanical force adjustments and efficient irreversible holding.

U.S. Pat. No. 3,066,931 to Beals (1962) C-Clamp With Ratchet Action Screw: reducing time in laboriously threading the clamp screw long distance both ways.

U.S. Pat. No. 3,147,003 to Johnson (1964) Fast Action C-Clamp: for locking the nut . . . so there is no possibility of the nut and screw rotating in such a way as to loosen the clamp when this is not desired.

U.S. Pat. No. 4,582,307 to Wang (1986) C-Clamp: provided with a threaded surface which can be rotated pivotally to engage or disengage with the screw, whereby one can determine a fast action operation mode or a normal operation mode of the c-clamp.

U.S. Pat. No. 4,823,636 to Suska (1989) Wrenchable C-Clamp: Is formed with a hexagonal portion coaxial with clamping screw and sized to fit standard open-end and box wrenches. A user can apply a wrench to the wrenchable portion to hold the c-clamp in a desired position while clamping screw is actuated.

U.S. Pat. No. 5,568,916 to Gibbons (1996) Quick Set And Release Clamping Device: . . . allows the user to freely move the threaded rod back and forth without having to turn the thread rod in and out.

U.S. Pat. 5,893,553 to Pinkous (1999) A Portable C-Clamp with Non-Rotatable Clamping Pad Means: Has a blocking bar detachably secured to the upper pad to prevent rotation of the pad and has a swivel pad on the lower anvil means for engagement with the clamped article.

U.S. Pat. No. 6,029,964 to Bohl (2000) Clamp With Swivel Pads: relates to generally clamping apparatus and more particularly to an improved removable swivel pad for the gripping pads of a clamp.

U.S. Pat. No. 6,098,973 to Khachatoorian (2000) C-Clamp: to allow the user to freely move the threaded rod position of the device back and forth relative the clamping frame without having to rotate the threaded rod portion.

U.S. Pat. No. 6,113,089 to Kleinbongartz (2000) Screw Clamp: to provide a screw clamp, in particular an all-steel screw clamp, which is more secure with respect to vibration.

U.S. Pat. No. 6,250,621 to Ping (2001) Clamp: an improved clamp for clamping an article between an anvil and a striker head.

Nevertheless, while all of the above clamps and c-clamps are all fine inventions, none have the c-clamp equipped with the holding-device needed to apply said simple-repair-method which can repair-cracks in violins on the interior of the violin without removing the violin's soundboard.

This simple-repair-method requires a c-clamp which:

a) is equipped at the top with a Thumb-turn screw having a Swivel clamping-pad with a cork-bottom pad, which prevents the clamping-pad from scratching or marring the violin's fine exterior surface, b) having the bottom-end of the c-clamp equipped with the holding-device which is able to hold and apply repair-cleats across each crack from the interior of violins.

c) The width of the bottom-end of the c-clamp, with the holding-device, corresponds to the width of the violin's original designed f-shaped sound-hole through the violin's soundboard.

This allows the bottom-end of the c-clamp, with the holding-device with the repair-cleat attached, to pass freely through the f-shaped sound-hole into the interior of the violin, and be moved to the position of the crack needing the repair-cleat.

NOTE: From which derives my present invention's title: "Interior C-Clamp's Holding-Device."

Objects and Advantages

Accordingly, besides the objects and advantages of the interior c-clamp's holding-device described in my above patent, further objects and advantages are:

a) to provide a c-clamp's holding-device that will make said interior repairs with speed and accuracy.

b) To provide the interior c-clamp's holding-device which is user friendly, a hand-held tool needing no batteries, or electric-power, is simple in construction and inexpensive to manufacture.

Still further objects and considerations will become apparent from the consideration of the ensuring description and drawings.

DRAWINGS FIGS. 1 THROUGH 4

FIG. 1: PROFILE of interior c-clamp's holding-device, located at the bottom-end of a c-clamp FIG. 2: SECTION view of c-clamp's top-end positioned on surface of violin's sound-board, and bottom-end of c-clamp inserted into the violin, with repair-cleat held in position by the holding-device. Shows interior repair in progress.

Figure 2:
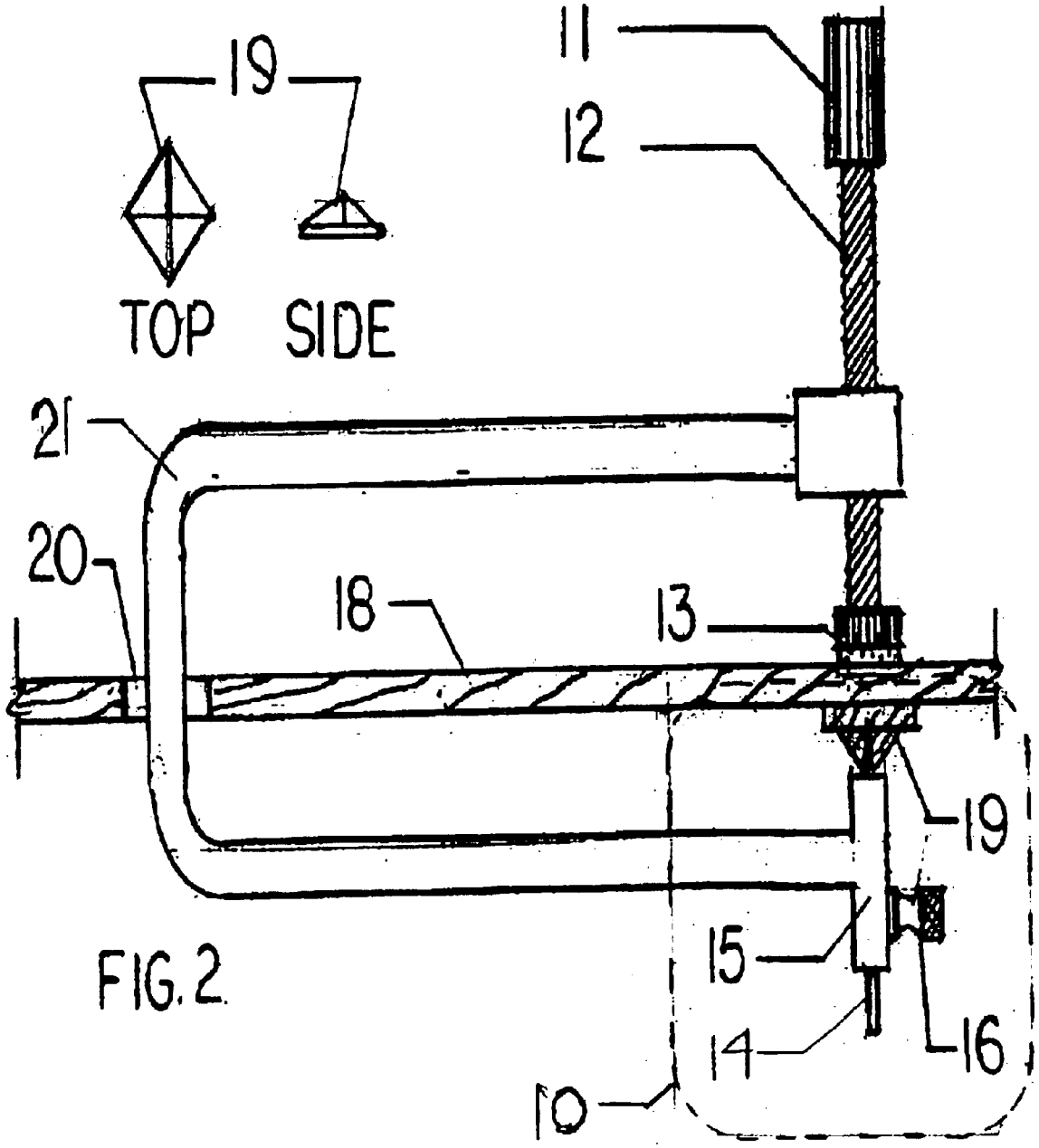
Figure 2A:
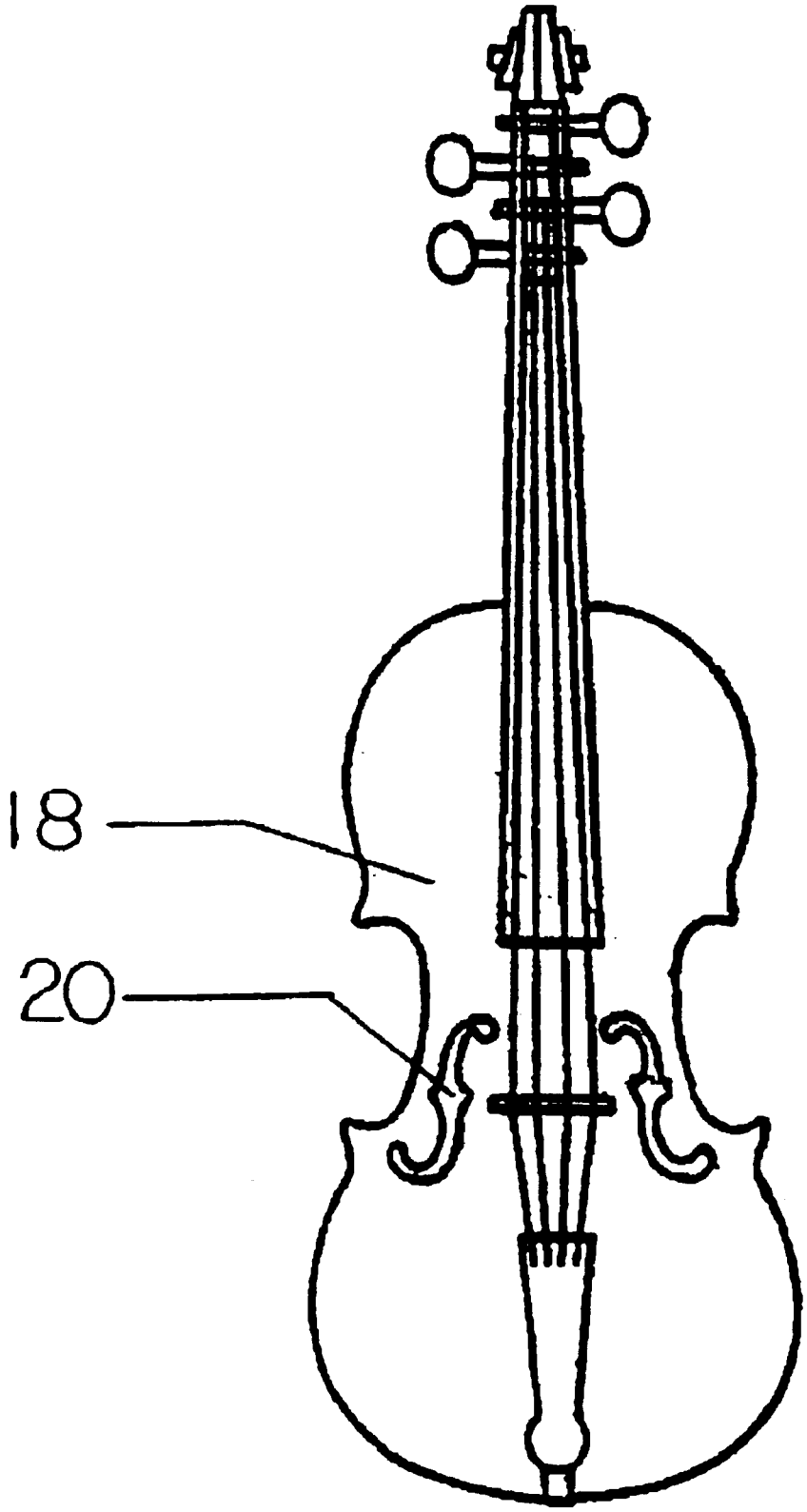

FIG. 2A: FRONT ELEVATION view of the violin showing soundboard, and f-shaped sound-holes.

Figure 2B:
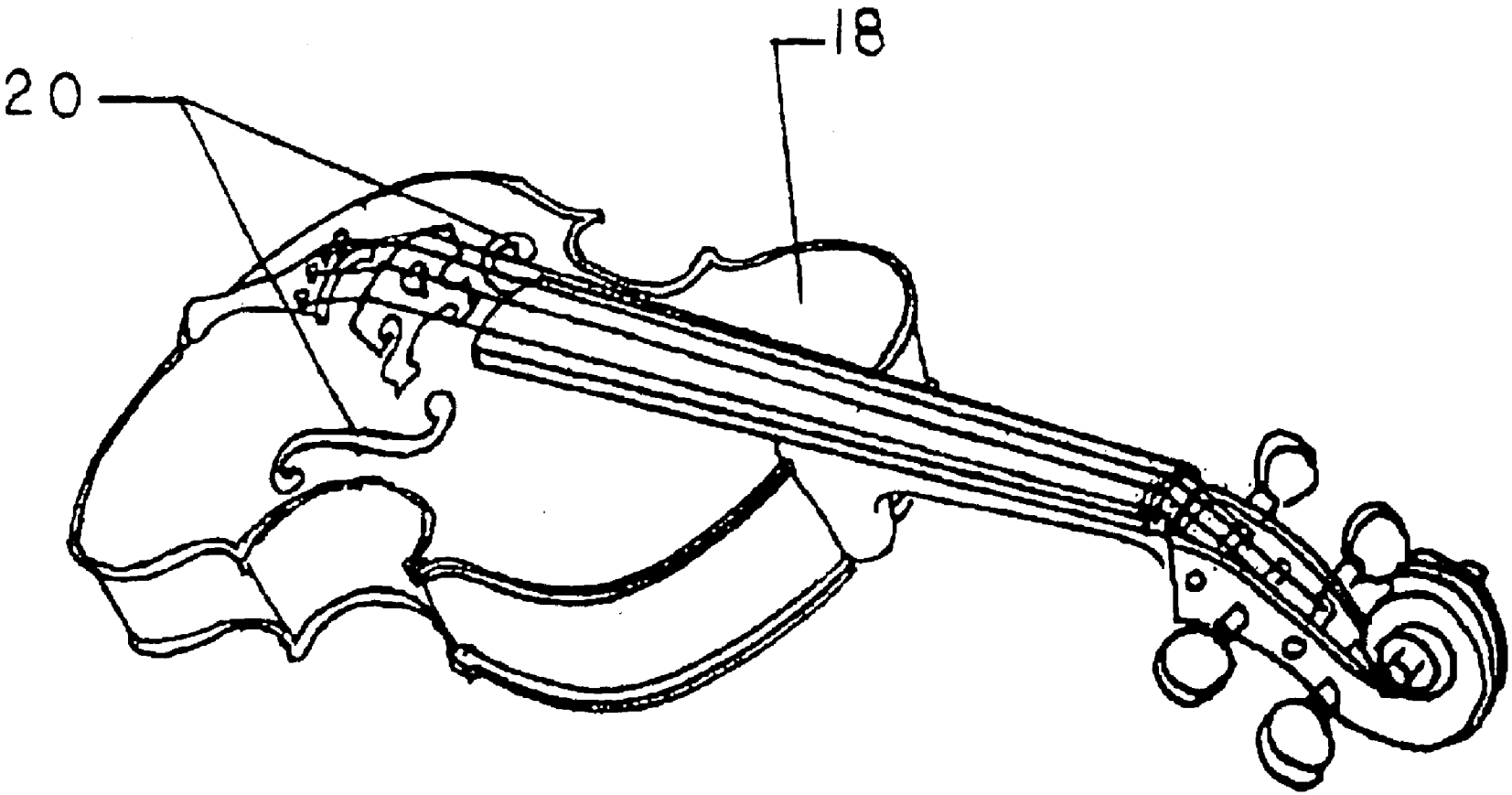

FIG. 2B: PROSPECTIVE view of the violin showing soundboard and f-shaped sound-holes.

Figure 2C:
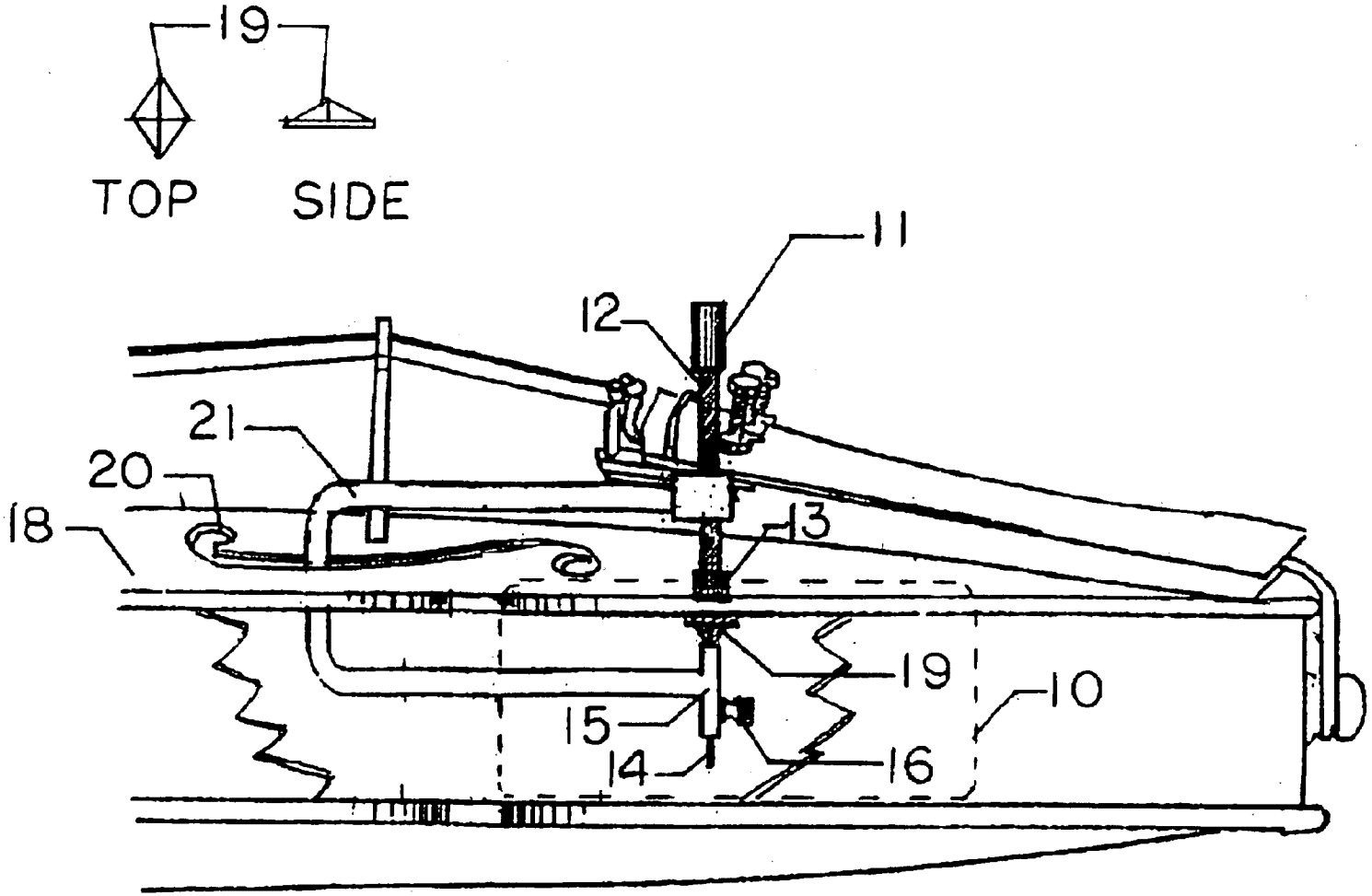

FIG. 2C: CUT AWAY SIDE ELEVATION view of c-clamp's top-end positioned on soundboard's surface, and bottom-end inserted through f-shaped sound-hole, through the violin's sound-board, and into interior of violin, with repair-cleat held in position by the holding-device. Shows interior repair in progress FIG. 3: ENLARGED DETAIL view of adjustable-needle held and adjusted—raised or lowered—in the holding-device.

Figure 3:
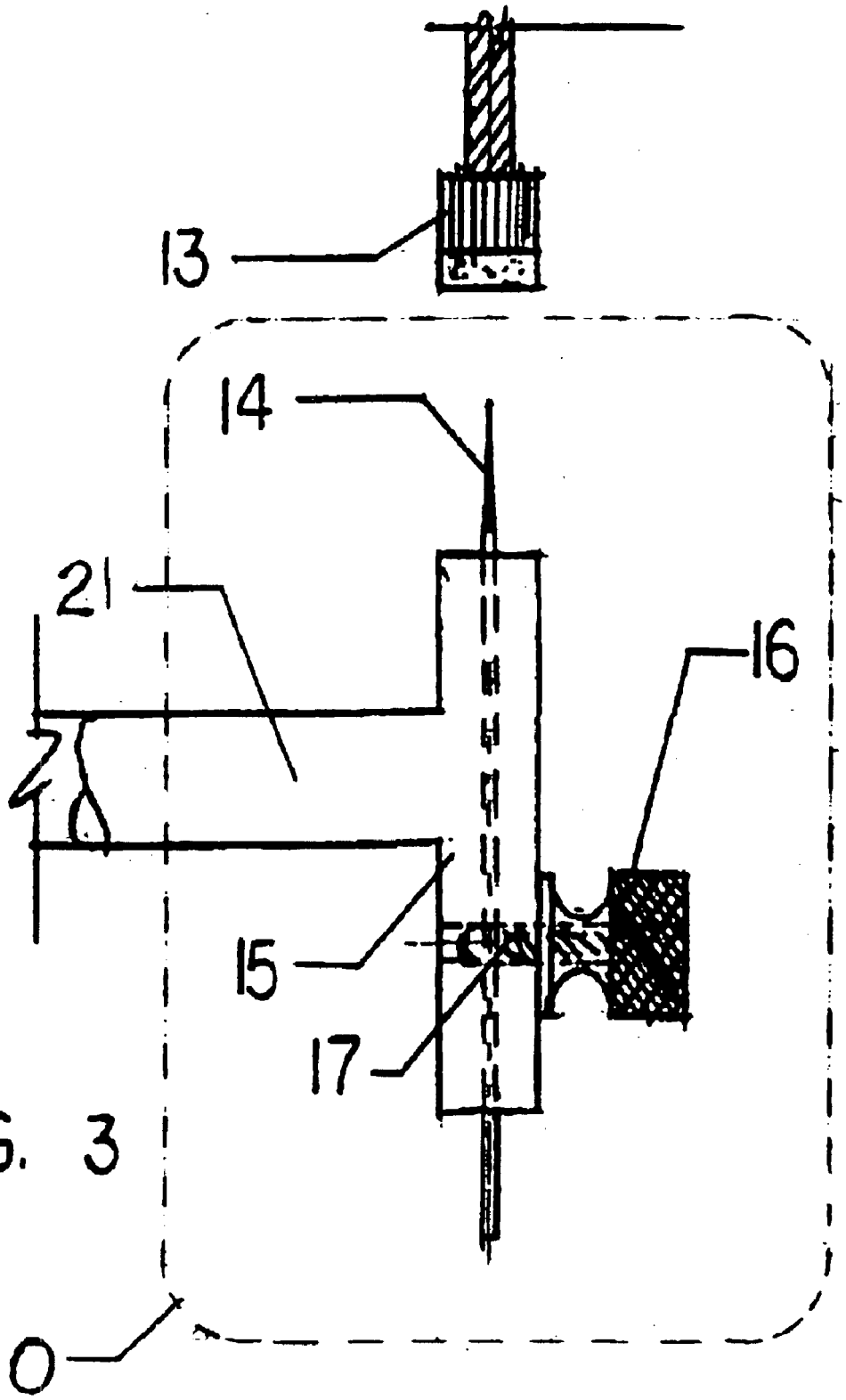
Figure 3A:
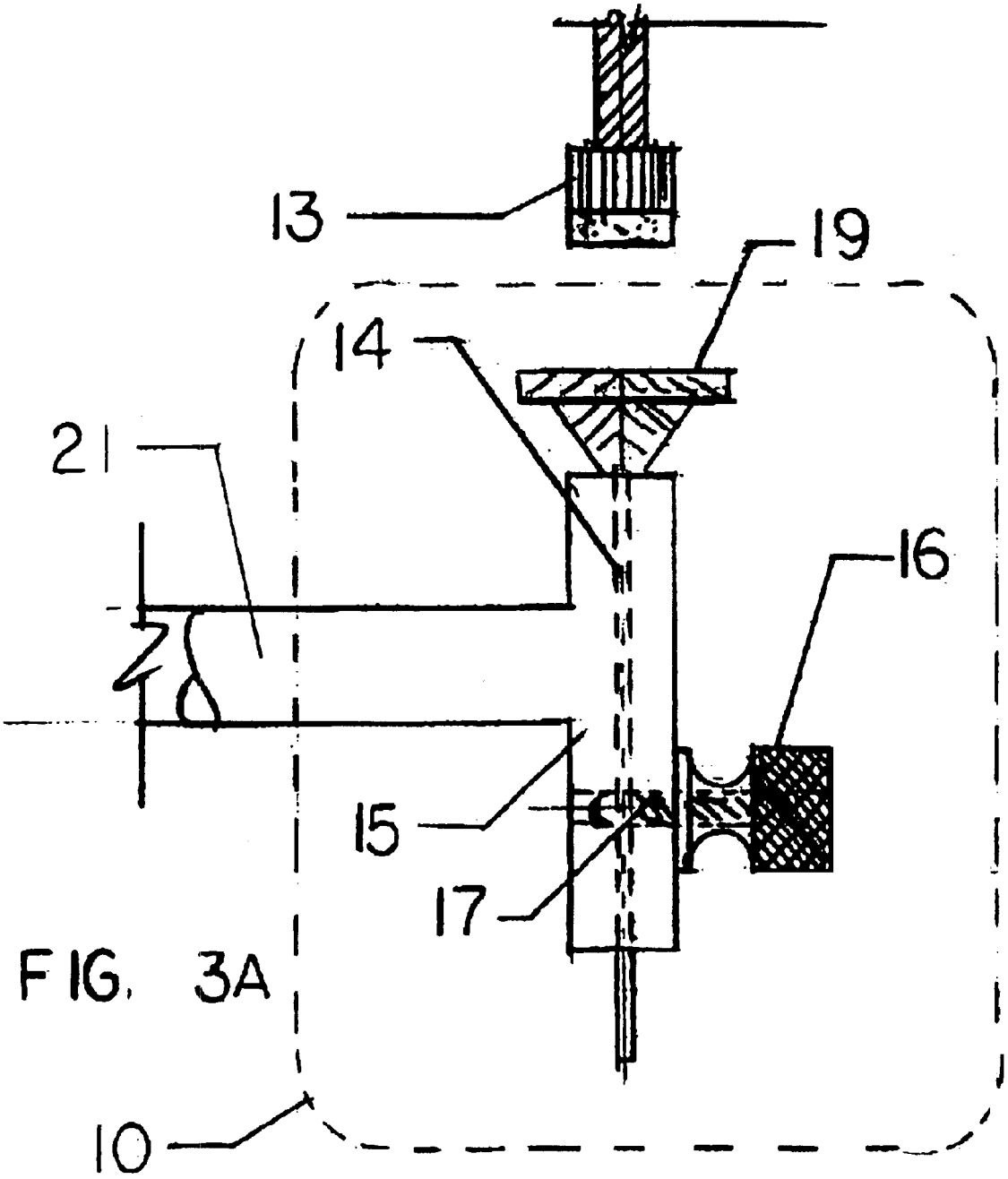

FIG. 3A: ENLARGED DETAIL view of holding-device with repair-cleat held in position on the adjustable-needle.

Figure 4:
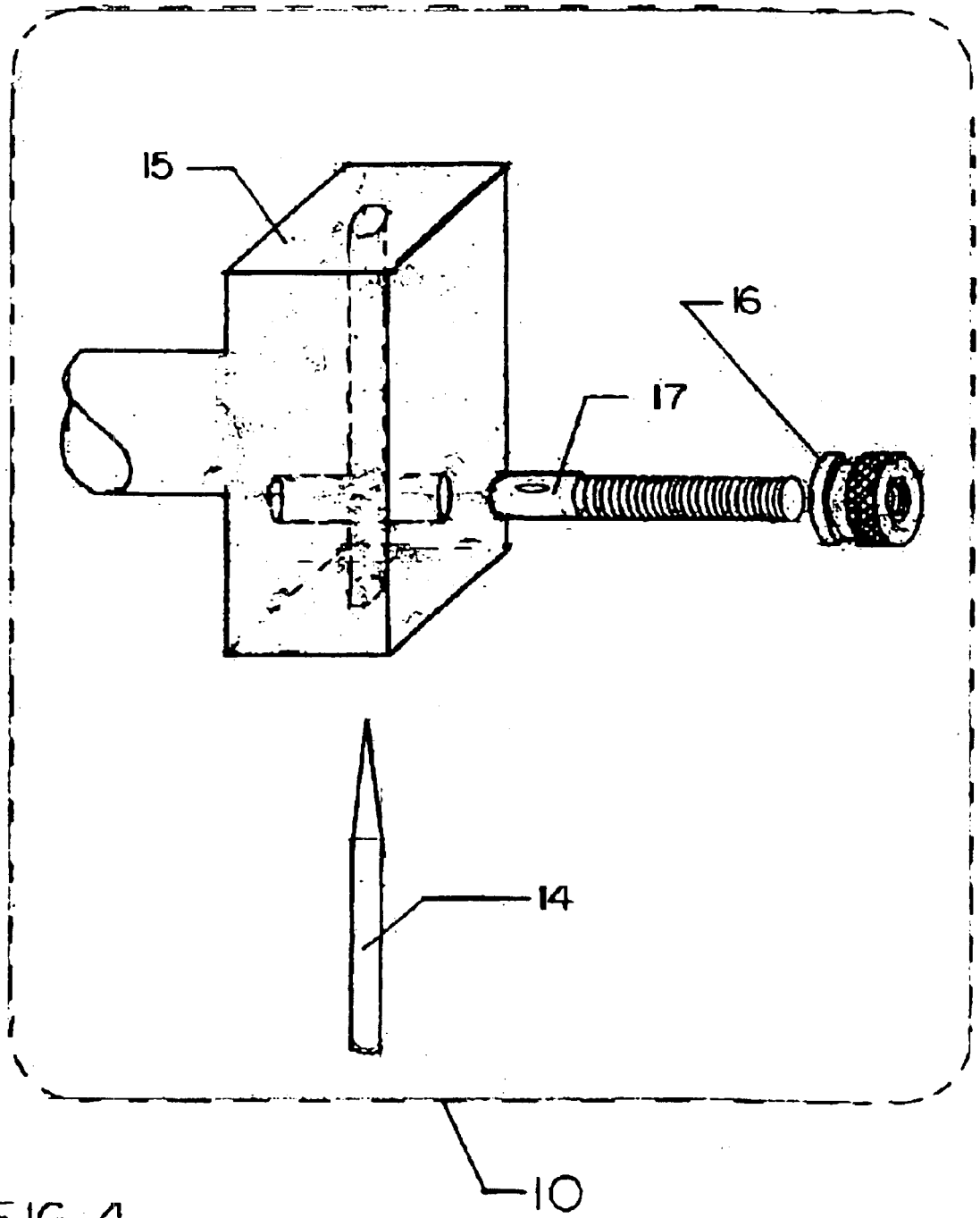

FIG. 4: EXPLODED view of present invention's four components

REFERENCE NUMBERS IN DRAWINGS

10. Present invention: Interior C-Clamp's Holding-Device

11. Thumb-turn

12. Screw

13. Swivel Camping-pad with cork-bottom pad, which prevents scratching sound-board's fine exterior surface.

14. Adjustable-Needle, which holds the repair-cleat in position during the gluing process. Height of the needle is regulated for the thickness of the repair-cleat.

15. Holding-Device, holds adjustable-needle, needle-locking screw, and needle-locking thumbscrew.

16. Needle-Locking Thumbscrew: Needle height adjustment locking thumbscrew.

17. Needle-Locking Screw. The adjustable-needle passes through the eye-hole of this screw when being inserted through the holding-device. By tightening the Needle-Locking Thumbscrew (16) the adjustable-needle is pulled against the interior-wall of the holding-device and held tight in position.

18. Soundboard: top section of the violin

19. Repair-cleats: top view and side view

20. F-shaped Sound-holes: through which the holding-device can enter and exit the interior of the violin

21. C-Clamp frame that holds the Holding-Device.

SUMMARY

In according with the interior c-camp's holding-device (present invention) comprises four components which are assembled together at the bottom-end of the c-clamp during production at the factory.

DESCRIPTION FIGS. 1 TO 4

A typical embodiment of present invention (10) is illustrated in FIG. 1 (profile view), and FIG. 3 (enlarged detail view).

Present invention (10) comprises four-components: Adjustable-Needle (14), Holding-Device (15), Needle-Locking Thumbscrew (16), and Needle-Locking Screw with an eye-hole (17), all of which are assembled together at the bottom-end of a c-clamp (21). FIGS. 4,3,1.

The holding-device (15) has therein both a horizontal and a vertical passage bored through the holding-device's (15) exterior walls, creating an intersection in the interior of the holding-device (15) where the two borings meet. FIG. 4

The needle-locking screw (17) having an eye-hole (17) at one end, and a needle-locking thumbscrew (16) at the opposite end (17). FIG. 4.

Through the horizontal boring is placed the needle-locking screw (17), placing its eye-hole (17) into the intersection, and placing the needle-locking thumbscrew (16) at the end of the horizontal passage, out on the holding-device's (15) exterior side-wall opening. Thus allowing accessibility to said thumbscrew (16). FIGS.4, 3.

Through the vertical boring is inserted the adjustable-needle (14) which passes through said eye-hole (17) and allowed to protrude just beyond the top-opening of the holding-device (15). FIGS. 4, 3.

The adjustable-needle (14) is slightly taller than the holding-device (15) which allows the adjustable-needle (14) to protrude slightly beyond both the top-opening, and the bottom-opening, of the holding-device (15). FIG. 3.

The adjustable-needle (14) is adjusted-raised or lowered-according to the thickness or thinness of the repair-cleat (19) needed. FIGS. 3 and 3A.

Manually raising or lowering the bottom-end of the adjustable-needle (14) at the holding-device's (15) bottom-opening, will rise or lower the top-end of the adjustable-needle (14) at the holding-device's (15) top-opening. FIG. 3

Having adjusted-raised or lowered- the adjustable-needle (14), then turning the needle-locking thumbscrew (16) clockwise will press/lock the adjustable-needle (14) against the holding-device's (15) interior wall at the adjusted height for the repair-cleat (19) process. Then repair-cleat (19) be positioned on the tip of the adjustable-needle (14), and glue applied on the surface of the repair-cleat (19). FIGS.3 and 3A.

Exact position for each needed repair-cleat (19) is lightly marked, easily-erasable, across the crack on the sound-board's (18) exterior/visible top-surface. FIGS. 2A,2B.

Furthermore, because the holding-device (15) is directly below the clamping-pad (13), the alignment of the clamping-pad (13) over the crack on the visible exterior of the violin will assure alignment of the repair-cleat (19) over the crack on the not visible interior of the violin. FIGS. 1,3,3A,2,2C.

The width of the c-clamp (21) with the holding-device (15) corresponds to the width of the violin's soundboard's (18) f-shaped sound-hole (20). This allows the bottom-end of the c-clamp ((21), with the holding-device holding the repair-cleat (19), to pass freely through the f-shaped sound-hole (20) into the interior of the violin, and be moved to the position of the crack needing the repair-cleat (19). FIGS. 2,2A,2B,2C.

Then the c-clamp (21) is tighten/closed using the thumbscrew (11) located at the top of the c-clamp (21): From which derives two actions simultaneously:

a) at the top-end of the c-clamp (21): allows the screw's (12) swivel 'clamping-pad' with the cork-bottom pad (13) to rest securely on the surface of the violin's soundboard (18) without scratching or marring the violin's fine exterior surface.

b) at the bottom-end of the c-clamp (21): allows the holding-device (15) with the repair-cleat (19), to press/glue the repair-cleat (19) securely across the crack on the interior of the violin.

The glue on the repair-cleat (19) now allowed to dry. Then the c-clamp (21) with the holding-device (15) can be loosened and removed through the f-shaped sound-hole (20) having completed the interior repair in the violin. FIGS. 2,2C,2A,2B,1.

The interior c-clamp's holding-device (10) can be made of stainless steel or any other durable material available.

From the description above, a number of advantages of present invention (10) become evident:

a) it eliminates the need to remove the violins's soundboards (18) to make said interior repairs.

b) it eliminates additional damage to the violins caused by the removal of the violins's soundboards (18).

c) it reduces excessive time and labor cost for the consumers.

OPERATION—FIGS. 1 TO 4

Present invention (10) is simple to use having all its (10) components assembled together at the bottom-end of the c-clamp (21) during its (10) production at the factory. FIGS. 4,3, and 1.

To operate present invention (10) requires only to manually turn the needle-locking thumbscrew (16) counterclockwise to unlock and adjust-rise or lower- the adjustable-needle (14) according to the thickness, or thinness, of the needed repair-cleat (19). Then turning the needle-locking thumbscrew (16) clockwise will lock the adjustable-needle (14) at the adjusted height.

Manually, press the repair-cleat (19) down on the tip of the adjustable-needle (16) until the underside of the repair-cleat (19) rests on the holding-device's (15) top-opening. Glue is then applied on the surface of the repair-cleat (19). FIGS. 3 and 3A.

The bottom-end of the c-clamp (21), with the holding-device (15) holding the repair-cleat (19), will pass freely through the f-shaped sound-hole (20) into the interior of the violin, and be moved to the position of the crack needing the repair-cleat (19). FIGS. 2A,2B,2,2C.

The c-clamp (21) is then tightened/closed which glues, thus secures, the repair-cleat across the crack on the interior of the violin, then allow the glue on the repair-cleat (19) to dry. FIGS. 2,2C.

When sufficient time has elapsed for the glue on the repair-cleat (19) to dry, the repair-cleat is secured across the crack on the interior of the violin. Then the c-clamp (21) can be loosened and lowered slightly to disengage the secured repair-cleat (19) from the tip of the adjustable needle (14).

Then the bottom-end of the c-clamp (21), with the holding-device (15) holding the adjustable-needle (14), can be removed through the violin's f-shaped sound-hole (20), having completed the violin's interior-repair. FIGS. 2A,2B, and 1.

For Larger Repair-cleats (19)

If the repair-cleat (19) is larger than the f-shaped sound-hole (20) then: First, adjust the adjustable-needle (14)—raise or lower—according to the thickness, or thinness, of the needed repair-cleat (19), then insert the lower portion of the c-clamp (21), with the holding-device (15) holding the adjustable-needle (14), through the f-shaped sound-hole (20) into the interior of the violin.

Then using tweezers, lower the larger repair-cleat (19) through the violin's f-shaped sound-hole (20) and position the repair-cleat (19) securely on the tip of the adjustable-needle (14) then apply glue to the surface of the repair-cleat (19) and proceed with the interior repair as stated above. FIGS. 3,2A,3A,2,2C,2B.

For Speedy Repairs

When the adjustable-needle (14) is adjusted/lowered to hold the thin repair-cleat (19), as many as needed thin repair-cleats (19) repairs can be made in succession with that one adjustment for thin repair-cleats (19). FIGS. 3,3A,2,2C, 2B.

Likewise, when the adjustable-needle (14) is adjusted/raised to hold the thick repair-cleat (19), as many as needed thick repair-cleat (19) repairs can be make in succession with that one-adjustment for thick repair-cleats (19) FIGS. 3,3A,2,2C,2B.

Seldom do violin's cracks require only one thin and only one thick repair-cleat (19), however, should that happen then repeatedly adjusting the adjustable-needle (14), to rise or lower it (14), only takes a minute or two. FIG. 3.

Cleaning Interior C-clamp'S Holding-device

Occasionally, due to fine saw-dust particles and/or excess glue, the holding-device (15) may need to be cleaned, all of which requires four simple manual steps:

1. Turn the needle-locking thumbscrew (16) counterclockwise to unlock the adjustable-needle (14). From the holding-device's (15) bottom-opening remove/pull-out the adjustable-needle (14). FIGS. 3,4.
2. By the needle-locking thumbscrew (16): remove/pull-out the needle-locking screw (17) FIG. 3, and 4. Resulting with the holding-device (15) now being completely empty thus now:
3. Clean out the horizontal and vertical borings then polish the adjustable-needle (14), the needle-locking screw (17), and the needle-locking thumbscrew (16). FIG. 4.

To Reassemble the Above: Reverse Steps 1,2, and 3 a) Insert the needle-locking screw (17) into the horizontal boring, placing its eye-hole (17) into the intersection, and placing the needle-locking thumbscrew (16) at the end of the horizontal boring, out on the holding-device's (15) exterior side-wall opening. FIGS. 4,3.

b) Through the vertical boring insert the adjustable-needle (14) which passes through the needle-locking screw's eye-hole (17) and the tip of the adjustable-needle allowed to protrude at the holding-device's (15) top-opening, and the bottom-end of the adjustable-needle (14) extends out at the holding-device's (15) bottom-opening. FIGS. 4,3.

c) Turning the needle-locking thumbscrew (16) clockwise will press/locks the adjustable (14) against the holding-device's (15) interior-wall. FIG. 3. Thus the cleaning process is completed. FIGS. 4,3,1.

Present invention (10) is simple to use and easy clean.

Summary, Ramifications, and Scope

The reader will see that this invention can be used easily, conveniently, and without damage or disturbance to the musical-string instruments. FIG. 1,3,4.

In addition, the interior c-clamp's holding-device (10) can be manufactured in various sizes, including sizes for repairing cracks in violins, violas, cellos, and string-basses: All having f-shaped sound-holes ((20) through their soundboards (18) through which present invention (10) can make the interior repairs without removing these instruments' soundboards (18). FIGS. 1,2A,2,2B,2C.

Furthermore, the interior c-clamp's holding-device (10) has the additional advantage in that, it provides help to our pubic schools' music-classes and their students who have violins, violas, cellos, and string-basses, cast aside due to cracks in these instruments. Present-invention (10) can repair these musical string-instruments without removing the soundboards (18), saving our public schools' music-classes, and their students, both time and labor cost.

to provide consumers with present invention (10) with its (10) simple-repair-method, to repair-cracks on the interior of their violins, violas, cellos, and string-basses, without removing the sound-boards (18), thereby helping consumers help themselves, which will save consumers time and labor cost.

To provide the c-clamp's holding-device, which is user friendly, the simple hand-help tool needing no batteries or electric power to operate. It is simple in construction and inexpensive to manufacture, it is economical, cost efficient, and attractive to individual consumers, investors, and specific companies.

Although the description above contains many specifications, these should not be construed as limiting the scope of the invention but as merely providing illustrations of some of the presently preferred embodiment of this invention.

For example, although the interior c-clamp's holding-device is primarily designed for the violin, present invention can also be applicable to many other industries.

Present invention: "Interior-C-Clamp's Holding-Device", consists of only four components: said holding-device, which holds therein, the adjustable-needle, needle-locking screw, and needle-locking thumbscrew, all of which are assembled together at the base of a c-clamp during production at the factory.

Likewise, said present invention can be produced in multiple sizes and attached to many various types of clamps and c-clamps frames during production at the factory, for various industries, according to the needs of the Market-Place.

Thus the scope of the invention should be determined by the appended claims and their legal equivalents, rather than by the examples given.

I claim:

1. An interior c-clamp's holding-device for repairing cracks on an interior of violins without opening the violins said interior c-clamp's holding device comprising a including a c-clamp frame with a swivel clamping pad, said holding-device having both a horizontal and a vertical passage bored through said holding-device, thus having an intersection inside the holding-device where the two passages meet, having inserted into the vertical passage an adjustable-needle set to hold a repair-cleat, and having inserted into the horizontal passage a needle-locking screw adapted to hold said adjustable-needle, having said horizontal and vertical passages bored through the holding-device's exterior walls, thus having top, bottom and sides exterior wall openings through which to insert said adjustable-needle and needle-locking screw.

2. The interior c-clamp holding-device as claimed in claim 1, wherein said needle-locking screw, having an eye-hole at one end and a needle-locking thumbscrew attached at the opposite end, is inserted into the horizontal passage, thus having the eye-hole placed into said intersection and the needle-locking thumbscrew placed at the end of said horizontal passage, out on the holding-device's exterior side-wall opening, thus allowing accessibility to said needle-locking thumbscrew.

3. The interior c-clamp's holding-device as claimed in claim 2, wherein the adjustable-needle with a point, which passes through said needle-locking screw's eye-hole.

4. The interior c-clamp's holding-device as claimed in claim 3, wherein the adjustable-needle, through said intersection/eye-hole, is regulated by turning said needle-locking thumbscrew clock-wise adjusting the height needed for repair-cleat process, turning the needle-locking thumbscrew counter-clockwise unlocks the adjustable-needle when repair is completed.

5. The interior c-clamp's holding-device as claimed in claim 3, wherein said adjustable-needle is taller than the holding-device which allows the adjustable-needle to protrude beyond both the top-opening, and the bottom-opening, of the holding-device.

6. The interior c-clamp's holding-device as claimed in claim 1, wherein the top of the c-clamp frame has a thumb-turn screw which has a swivel clamping-pad with a cork-bottom, which prevents the clamping-pad from scratching or marring the violin's fine exterior surface, and the base of said c-clamp, with the holding-device, corresponds to the width of violin's original designed f-shaped sound-holes through the violin's soundboard.

7. The interior c-clamp's holding-device as claimed in claim 1, wherein said interior c-clamp's holding-device is manufactured in various sizes, including sizes for repairing cracks in violins, violas, cellos, and string-basses, all having f-shaped sound-holes through their soundboards through which present invention can make said interior repairs without removing these musical string-instruments' soundboards.

8. The interior c-clamp's holding-device as claimed in claim 1, where the interior c-clamp is made of stainless steel.

* * * * *